United States Patent [19]

Ieda

[11] 4,073,087

[45] Feb. 14, 1978

[54] TOY VEHICLE HAVING PARACHUTE ATTACHED THERETO

[75] Inventor: Michael E. Ieda, Fort Solanga, N.Y.

[73] Assignee: Ideal Toy Corporation, Hollis, N.Y.

[21] Appl. No.: 653,975

[22] Filed: Jan. 30, 1976

[51] Int. Cl.[2] ..... A63H 29/20; A63H 17/42

[52] U.S. Cl. ..... 46/202; 46/86 R; 46/209

[58] Field of Search ..... 46/86 R, 86 A, 86 C, 46/202, 209

[56] References Cited

U.S. PATENT DOCUMENTS

| | | | |
|---|---|---|---|
| 3,570,175 | 3/1971 | Angier | 46/209 |
| 3,589,055 | 6/1971 | Stromon | 46/202 |
| 3,757,459 | 9/1973 | Buck et al. | 46/202 |
| 3,798,829 | 3/1974 | Worley | 46/86 R |
| 3,844,557 | 10/1974 | Pompetti | 46/202 |

*Primary Examiner*—Louis G. Mancene
*Assistant Examiner*—Robert F. Cutting
*Attorney, Agent, or Firm*—Richard M. Rabkin

[57] ABSTRACT

A toy vehicle consisting of a vehicle body and a plurality of wheels rotatably mounted thereon includes means for receiving and containing a simulated parachute therein and ejection means for selectively ejecting the parachute in response to a predetermined sequence of positions attained by the vehicle body during movement along its path of travel.

19 Claims, 6 Drawing Figures

TOY VEHICLE HAVING PARACHUTE ATTACHED THERETO

The present invention relates to toy vehicles and, more particularly, to a toy vehicle in which a simulated parachute is ejected from the vehicle to simulate "braking" of the vehicle after the vehicle has moved through a predetermined sequence of positions.

High powered racing cars such as drag strip vehicles and so-called "Formula 1" racing cars are often provided with parachutes that are ejected by the operator from the vehicle in order to aid in slowing the vehicle to a stop after the completion of the race or run. Drag strip racers most commonly use such parachute assisted braking systems because of the relatively high speeds they attain within a short distance. These vehicles also often attain a "wheelie" configuration, i.e. they rise on and move forward solely on their rear wheels for a small period of time, because of their rapid acceleration.

in view of the popularity of automobile racing and drag strip racing in particular, a variety of different types of toy vehicles have been proposed in the past to simulate actual racing and drag strip vehicles. Such vehicles include various different features which attempt to realistically simulate the movement and actions of such racing vehicles.

It is an object of the present invention to provide a toy vehicle that includes a simulated parachute braking system to closely simulate the actions of a drag strip vehicle.

Another object of the present invention is to provide a toy vehicle having a simulated parachute braking system which will operate upon the movement of the toy vehicle through a predetermined sequence of positions.

A further object of the present invention is to provide a toy vehicle with a simulated parachute braking system which will operate to simulate braking of the vehicle after the vehicle has first moved through a "wheelie" position and returned to a flat out running position.

A further object of the present invention is to provide a toy vehicle which simulates a racing car that is relatively inexpensive in manufacture and durable in use.

Another object of the present invention is to provide a toy vehicle which includes a simulated parachute braking system and is power driven to obtain a "wheelie" position.

In accordance with one aspect of the present invention a toy vehicle is provided which consists of a vehicle body having a plurality of wheels rotatably mounted thereon and includes a rearwardly opening cavity in which a simulated parachute is stored. The parachute is selectively ejected from the body by an ejection mechanism which includes a piston movably mounted in the cavity and operatively connected to the shroud lines of the parachute. The piston is adapted to move between an innermost position within the cavity and an outermost position adjacent the outer edge of the cavity, with the movement of the piston from the inner to outermost positions causing the parachute to be ejected from the cavity. A spring is operatively engaged with the piston to bias the piston from its innermost to its outermost position and provide the ejection force.

A latching arrangement is provided to hold the piston rod in its innermost position against the bias of the spring until the toy vehicle has moved through a predetermined sequence of positions. This latching mechanism includes a piston rod for the piston that extends inwardly of the vehicle from the cavity. An extension of the piston rod, and a portion of the vehicle, include cooperating engaging means which hold the piston in its innermost position against the bias of the spring. Means are provided for disengaging the cooperating engaging means when the vehicle is in a flat out running position so as to allow the piston to move under the influence of the spring. However, in addition to these cooperating means, a separate latch mechanism is provided to normally hold the piston in its innermost position against the bias of the spring in the flat running position of the vehicle. This latch mechanism includes means for releasing the latch when the toy vehicle enters a "wheelie" position. As a result the piston is normally held in its innermost position in all positions of the toy vehicle until the vehicle attains a "wheelie" position whereby the latching mechanism is released so that when the vehicle returns to its flat out running position the cooperating means will be disengaged to allow the piston to move under the influence of the spring and thereby eject the parachute from the vehicle cavity.

In addition, the vehicle is preferably provided with a power drive system, such as for example a flywheel motor, so that it will move along its path of travel and obtain a "wheelie" position so that sequencing of the release of the piston can be effected.

The above, and other objects, features and advantages of this invention will be apparent in the following detailed description of an illustrative embodiment thereof, which is to be read in connection with the accompanying drawings, wherein.

Figure 1:
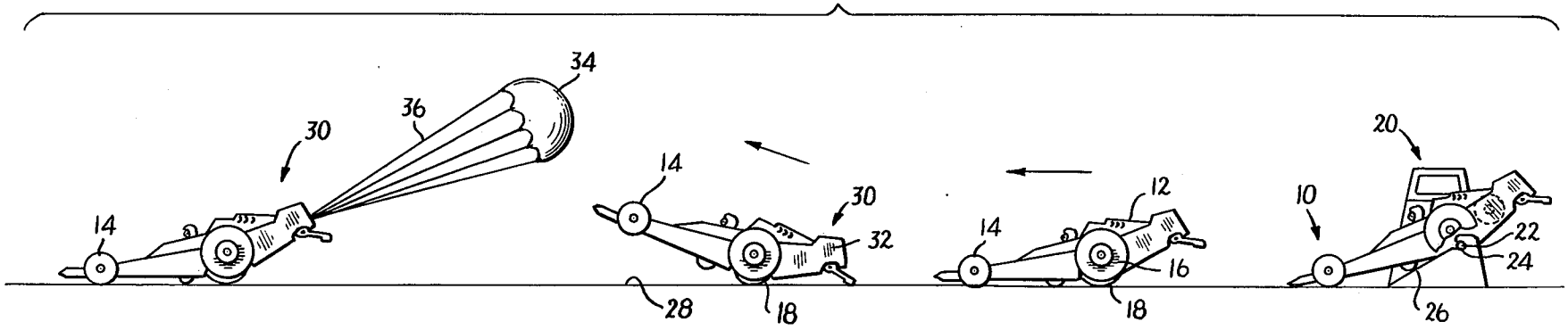
FIG. 1 is a side sequence view showing the movement of a vehicle constructed in accordance with the present invention through the sequence of positions which allows the simulated parachute to be expelled from the vehicle.

Referring now to the drawing in detail, and initially to FIG. 1 thereof, a toy vehicle 10 constructed in accordance with the present invention includes a vehicle body 12 formed of a molded plastic material and a plurality of ground engageable front and rear wheels 14, 16, rotatably mounted thereon. The vehicle body contains a flywheel motor including a centrally located ground engageable drive wheel 18 for propelling the toy vehicle along its path of travel. The flywheel motor is energized to relatively high speeds of rotation, for driving the ground engageable wheel 18, by an energizer structure 20, which may be identical to the energizer structure described in U.S. patent application Ser. No. 438,821, filed Feb. 1, 1974, commonly assigned herewith, and now U.S. Pat. No. 3,886,682. The flywheel motor housing 56 has support pins 22 formed therein which are supported in the notches 24 formed in energizer 20 so that during operation of the energizer drive wheel 18 of the flywheel motor is held in an elevated position and does not interfere with rotation of the wheel or energization of the flywheel motor. Once drive wheel 18 is rotating at the desired speed, the operator stops rotation of the energizer crank and the vehicle is automatically expelled from the energizer with drive wheel 18 dropping down onto the ramp 26 of the energizer to propel the vehicle forwardly. Since the vehicle is relatively light, by properly energizing the flywheel motor to a sufficiently high speed of rotation the vehicle will come off the energizer and move into a "wheelie" position wherein the front wheels 14 of the vehicle rise off of the surface 28 along which the vehicle travels.

In accordance with the present invention toy vehicle 10 includes a simulated parachute braking system 30 contained within the rear end 32 of the toy vehicle. This braking system includes a simulated parachute 34 which may be formed of paper or the like connected by flexible shroud lines 36 to a portion of the toy vehicle, as described hereinafter. The braking system is constructed such that parachute 34 is ejected from the toy vehicle only after the vehicle has moved through a "wheelie" position, as illustrated in FIG. 1, and returned to a horizontal flat out running position. This simulates the actions of a typical drag strip type racing vehicle which includes a parachute braking system to bring the vehicle to a halt.

Simulated parachute braking system 30 includes a rearwardly opening cavity 37 formed in the body 12 of the toy vehicle. This cavity contains a piston or ejection door 48 which includes a hook element 40 to which shroud lines 36 of parachute 34 are secured.

Figure 5:
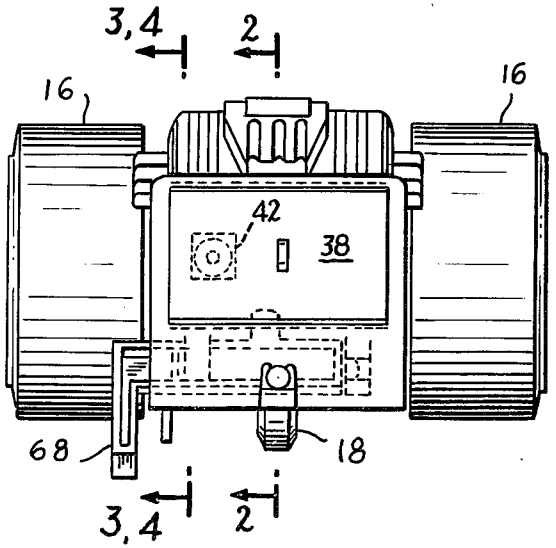
FIG. 5 is a rear view of the toy vehicle shown in FIG. 1.
Figure 2:
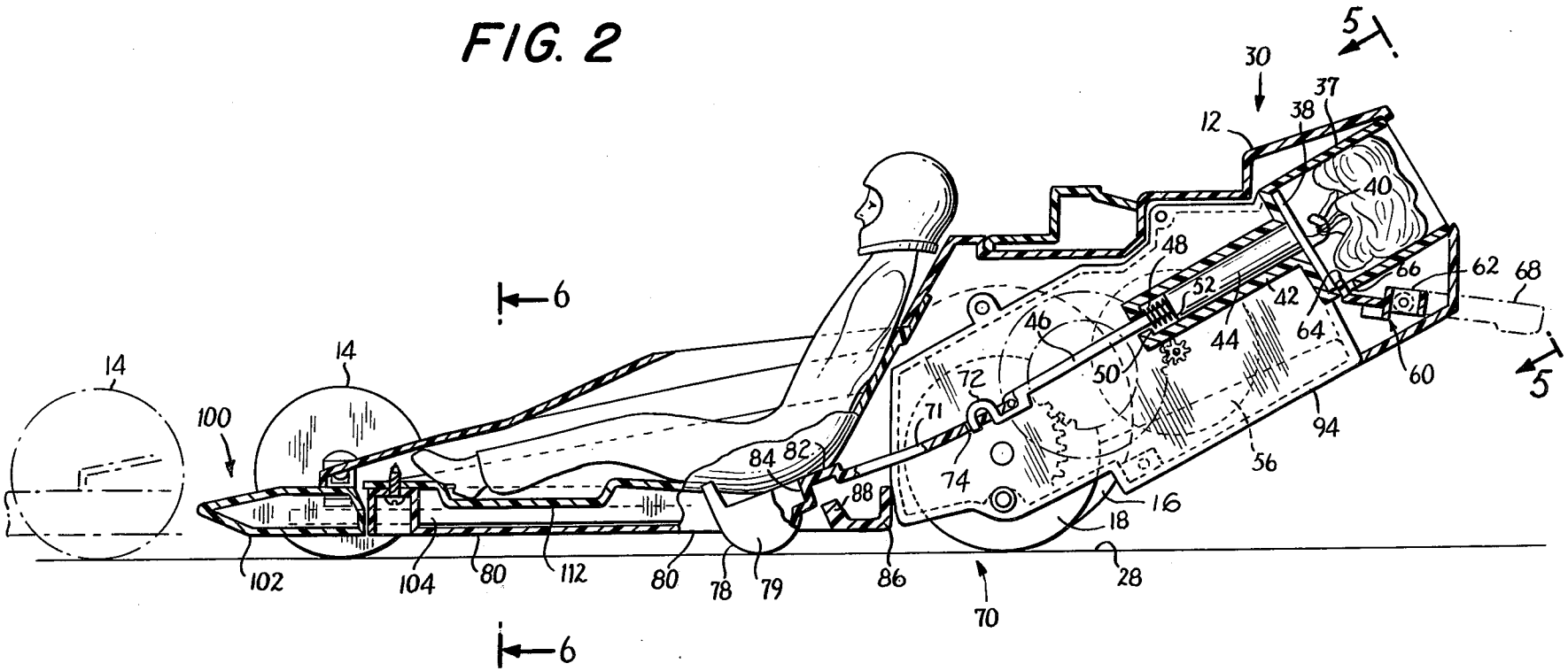
FIG. 2 is a sectional view of the toy vehicle shown in FIG. 1, showing the normal flat out running position of the toy vehicle and parachute ejection mechanism.

A hollow sleeve 42 is formed behind cavity 36 on one side of the center line of the vehicle (see FIG. 5). This sleeve slidably contains a piston or latch rod 44 which is formed integrally with piston 38. The piston rod has a section 46 of reduced diameter surrounded by a coiled spring 48 engaged at its opposed ends with one end 50 of the sleeve and abutment shoulders 52 formed on piston rod 44. Thus the spring normally biases piston 38 outwardly of the cavity 36. As seen in FIGS. 2 and 5, sleeve 42 and piston rod 46 are offset from the center line the vehicle and extend along the side of the flywheel motor housing 56 contained in the rear of the vehicle.

The piston or ejection door 38 is normally held in its innermost position, shown in FIG. 2, against the bias of spring 46 by a latch mechanism 60 which comprises an elongated bar 62 pivotally mounted in the rear of the toy vehicle's body, transversely of the longitudinal axis thereof. Bar 62 includes an abutment surface 64 which extends through an aperture 66 in the bottom wall of the cavity 38 so as to block outward movement of piston 38. The bar 62 also includes a lever extension 68.

Figure 3:
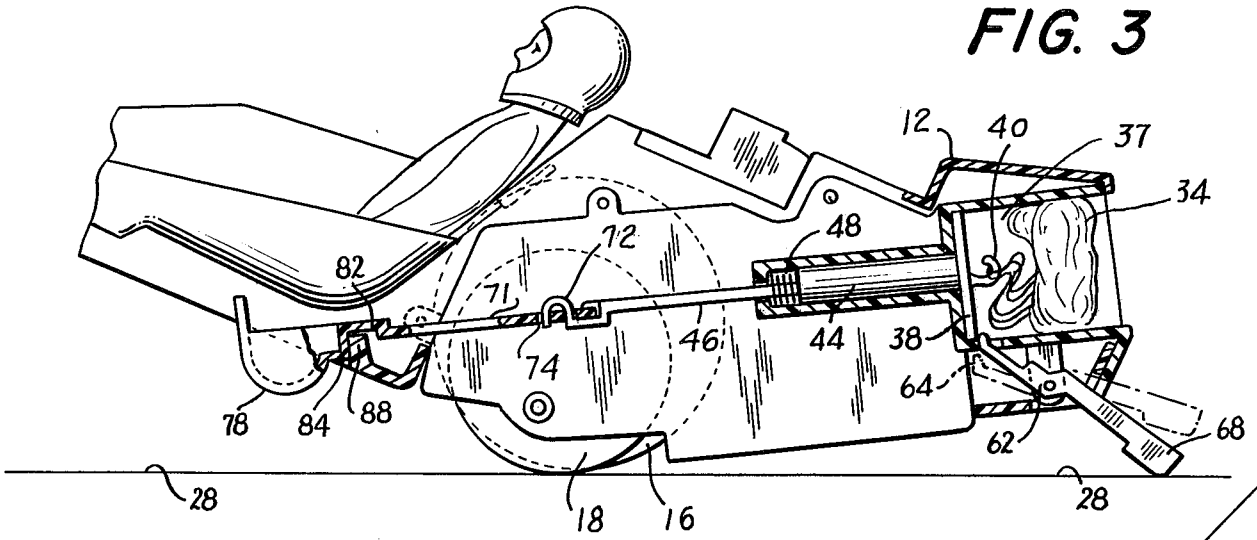
FIG. 3 is a partial side sectional view, similar to FIG. 2, showing the configuration of the parachute ejection apparatus in the "wheelie" position of the vehicle.
Figure 4:
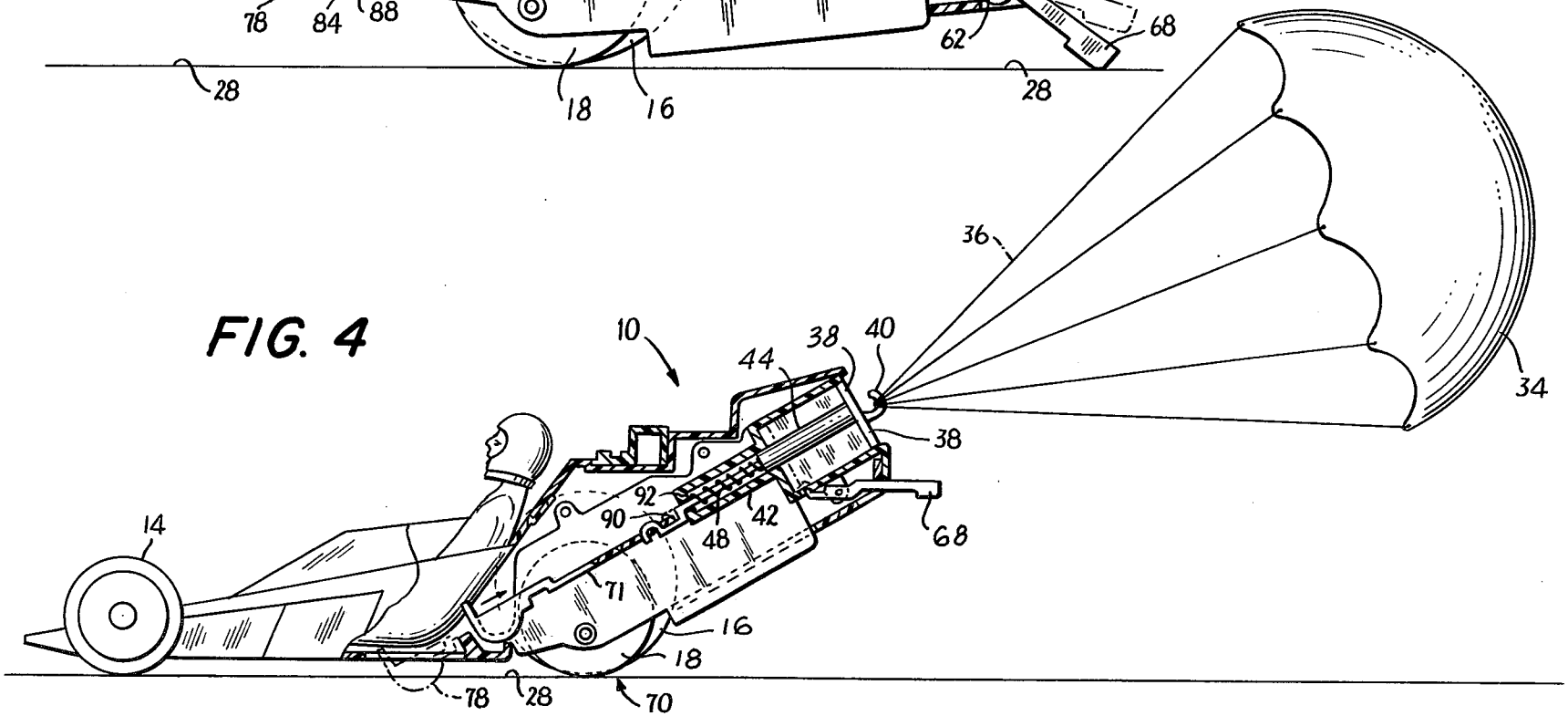
FIG. 4 is a side sectional view, similar to FIG. 3, showing the configuration of the ejection mechanism in the flat out running position of the vehicle, after the vehicle has passed through a "wheelie" position.

When playing with the toy vehicle, the operator depresses piston 38 against spring 46 and pivots bar 62, by properly operating arm 68, so that the abutment portion 64 is placed in front of piston 38 in order to block its movement. The pivotally mounted bar 62 remains in this position because of the tight engagement between piston 38 and abutment surface 64 under the influence of spring 48. This engagement holds bar 62 in this position and insures that piston 38 is not inadvertently released. By this arrangement, as seen in FIG. 3, when the toy vehicle enters its "wheelie" position arm 68 will engage running surface 28 and be pivoted in a counterclockwise direction, to move abutment surface 64 away from piston 38. This would free piston 38 for outward movement to eject parachute 34 from cavity 37. However, an additional latching arrangement 70 is provided in order to prevent ejection of the parachute from the vehicle in the "wheelie" position and to allow such ejection to occur only after the toy vehicle has returned to its flat out running position, as illustrated at the extreme left in FIG. 1.

This additional latching mechanism includes a resilient arm 71 rigidly secured to the end 72 of the piston rod 44 as an extension thereof in any convenient manner. As illustrated in the drawing, arm 71 has a pair of openings 74, 76, formed therein and the end 72 of the piston rod is hook shaped, and engaged in those openings.

Flexible arm 71 extends along the interior of vehicle housing 12 to a free end 78 formed as a contact surface or element 79 which passes through an opening 80 in the base of the vehicle to a position wherein it can engage the running surface 28 along which the vehicle moves, when the vehicle is moving in its flat out running position. The end 78 of arm 71 also includes an integral recess 82 formed therein which defines a rearwardly facing abutment surface or wall 84. The bottom wall 86 of the toy vehicle housing includes an abutment or stop member 88 which is adapted to be received in recess 82 and engaged with wall 84.

In the normal flat out running position of the toy vehicle, as illustrated in FIG. 2, contact element 79 rides on surface 28 along which the vehicle travels and causes arm 71 to flex upwardly, so that wall 84 and abutment surface 88 are out of engagement with each other. This would allow piston 38 to move outwardly under the influence of spring 48, but such movement is stopped by abutment surface 64 as described above.

When the toy vehicle enters its "wheelie" position, as illustrated in FIG. 3, contact element 79 is located out of contact with running surface 28, so that it is in its normal straight and unflexed position, whereby stop member 88 is received in recess 82 and engaged with wall 84. The engagement of these cooperating engaging means, i.e. stop member 88 and the abutment wall 84, prevents piston 38 from moving outwardly in cavity 37 under the influence of spring 48, even though abutment member 64 of bar 62 has been removed from engagement with piston 38 by the contact of arm 68 with surface 28, as described above. Thus piston 38 is held against outward movement while the vehicle remains in its "wheelie" position.

Finally, as the flywheel motor slows down, the vehicle will return from its "wheelie" position to its flat out running position. When that occurs contact element 79 re-engages running surface 28 and causes arm 71 to flex upwardly, into the position illustrated in FIG. 2, wherein cooperating means 84, 88 are disengaged. In that position, since movement of piston 38 is no longer blocked by abutment member 64 of latch mechanism 60, spring 48 pushes or urges piston 38 outwardly in cavity 37. This outward movement stops when the end 90 of arm 11 engages the end 92 of sleeve 42. However the outward movement of the piston ejects the parachute from cavity 37. The parachute will billow and fill with air to simulate the action of a parachute on a conventional drag strip vehicle, since vehicle 10 continues to move forwardly at a relatively rapid speed under the drive of the flywheel motor.

As seen in FIGS. 2 and 3, the rear end portion of the toy vehicle is inclined upwardly so that its bottom wall 94 forms a substantial angle with running surface 28. By locating bar 62 and arm 68 at the upper rearward end of the toy vehicle, the vehicle must obtain a substantial "wheelie" position before latch bar 62 is released. Thus if the operator does not sufficiently energize the flywheel motor so that the vehicle obtains the full "wheelie" position illustrated in FIG. 3, arm 68 will not engage the running surface and the parachute will not eject. This simulates the operation of an actual racing vehicle which does not require the use of its parachute braking system unless a minimum high speed is attained.

Figure 6:
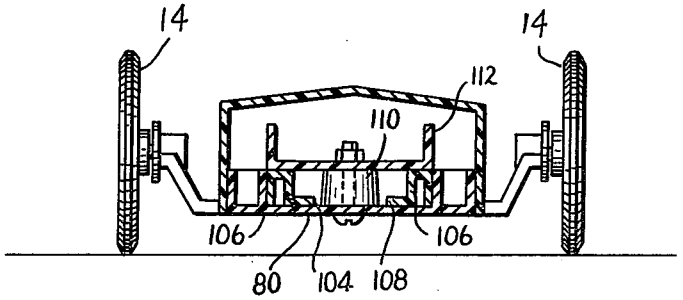
FIG. 6 is a sectional view taken along line 6—6 of FIG. 2.

To further simulate the appearance of a drag strip vehicle, toy vehicle 10 of the present invention includes an extensible nose or front edge portion 100. This includes a front end 102 on which front wheels 14 are rotatably mounted. Nose portion 100 includes an integral rearwardly extending plate element 104 which rests on the lower wall 80 at the front of the vehicle. This plate includes a pair of side wall elements 106 (FIG. 6) having an elongated slot 108 formed therebetween for receiving a mounting stud 110. Stud or boss 110 is used to secure the seat 112 of the vehicle to its bottom wall 86. Thus plate 104 is trapped between bottom wall 86 of the vehicle and the lower surface of seat 112 and can slide longitudinally with respect thereto in a frictional engagement. Accordingly, the operator can pull the front end or nose 100 of the vehicle outwardly in order to extend the length of the vehicle.

By extending the front end of the vehicle its center of gravity is changed so that the "wheelie" runs obtained by the vehicle will be shorter with the nose extended; while with the nose retracted, the "wheelie" runs will be longer.

Accordingly, it will be seen that the toy vehicle 10 of the present invention provides a relatively simply constructed vehicle arrangement that produces a realistic simulation of the braking of a drag strip type vehicle by a parachute braking system. The realism of the toy vehicle is enhanced by the latching mechanisms utilized therein to control the ejection of the parachute in accordance with a predetermined sequence of vehicle movements. Moreover, the extensible front of the vehicle allows the operator to vary the length of the "wheelie" movements which the vehicle will perform.

Although an illustrative embodiment of the present invention has been described herein with reference to the accompanying drawings, it is to be understood that the invention is not limited to that precise embodiment thereof, but that various changes and modifications may be effected therein by one skilled in the art without departing from the scope or spirit of this invention.

What is claimed is:

1. A toy vehicle adapted to move along a surface comprising, a vehicle body and a plurality of wheels rotatably mounted thereon, said vehicle body including means for receiving and containing a simulated parachute therein, and means for selectively ejecting a simulated parachute in said receiving means, and means for sensing when said vehicle has passed through a predetermined sequence of different relative positions with respect to the surface along which it is moving during movement along its path of travel and for actuating said ejecting means after said vehicle has passed through said sequence of different relative positions.

2. A toy vehicle adapted to move along a surface comprising a vehicle body, a plurality of wheels rotatably mounted on said vehicle body including at least one front wheel and at least one rear wheel, a simulated parachute secured to said body, said body including means for receiving and containing said simulated parachute therein, and means in said vehicle body for ejecting the simulated parachute from the vehicle body after the vehicle body has first attained a "wheelie" position, wherein said front wheel rises above the surface on which the vehicle moves, during movement along its path of travel and then returned from said "wheelie" position to a flat horizontal running position.

3. A toy vehicle as defined in claim 2 including drive means in said vehicle body for propelling the vehicle along its path of travel.

4. A toy vehicle as defined in claim 3 wherein said drive means comprises a flywheel motor.

5. A toy vehicle adapted to move along a surface comprising, a vehicle body having a plurality of wheels rotatably mounted thereon, said body including a parachute storage cavity formed therein; a simulated parachute removably stored in said cavity and operatively connected to the vehicle; and means for selectively ejecting said parachute from said body including a piston in said cavity, spring means for biasing said piston out of the cavity to eject a simulated parachute therefrom and first and second releasable latching means for holding said piston in said cavity against the bias of said spring means until said latching means are released in a predetermined sequence; said releasable latching means including contact elements for engaging the surface along which the vehicle travels and releasing their associated latching means, said first latching means being located in said body with respect to said piston to engage the piston and prevent release of the second latching means until the contact element of the first latching means engages said surface and releases the first latching means.

6. The toy vehicle as defined in claim 5 wherein said toy vehicle has at least one front wheel, at least one rear wheel, and an upwardly inclined rear end portion containing said cavity, said inclined rear end portion of the vehicle allowing the vehicle to assume a "wheelie" position wherein said front wheel rises above the surface along which the vehicle moves, and said first latching member being located in said rear end portion whereby its contact element engages said surface only when the vehicle is in a "wheelie" position.

7. The toy vehicle as defined in claim 6 wherein said first latching means comprises a lever pivotally mounted in said vehicle body having an abutment surface located to be positioned in blocking engagement with said piston to hold the piston in said cavity against the bias of said spring means, said lever including an arm defining said contact element located to engage the surface on which the vehicle travels when the vehicle is in a "wheelie" position, thereby to pivot the abutment surface away from said piston, freeing the piston for movement upon release of said second latch means.

8. The vehicle as defined in claim 7 wherein the contact element of said second latch means is operatively connected to said piston for movement therewith and said second latch means includes stop means on said vehicle body for preventing movement of the contact element with the piston under the influence of the spring, said contact element of the second latch means being located to engage the surface along which the vehicle travels when the vehicle is traveling in a "flat out" position to disengage that contact element from the stop thereby to allow the piston to move under the influence of said spring if the first latch means was previously unlatched.

9. The vehicle as defined in claim 5 wherein said vehicle body includes a longitudinally extensible front end portion.

10. A toy vehicle adapted to move along a surface comprising a vehicle body having a plurality of wheels rotatably mounted thereon including at least one front wheel and at least one rear wheel, said body including a rearwardly opening cavity formed therein and a simulated parachute removably stored in said cavity; and means for selectively ejecting said parachute from said body including a piston movably mounted in said cavity from an innermost position allowing the parachute to be stored in the cavity and an outermost position at which the parachute is ejected; spring means operatively engaged with said piston for biasing said piston from said innermost to said outermost positions; said piston including a piston rod extending inwardly of the vehicle from said cavity, said vehicle and said piston rod including cooperating engaging means for holding said piston in its innermost position against the bias of said spring means, means for disengaging said cooperating engaging means when said vehicle is in a flat running position, and releasable latching means for normally holding said piston in its innermost position against the bias of said spring in the flat running position of said vehicle and including means for releasing said latching means when the body vehicle is in a "wheelie" position wherein said front wheel rises above the surface along which the vehicle moves, whereby when the toy vehicle attains a "wheelie" position and said latching means is released said piston is held in its innermost position by said cooperating means and moves to its outermost position only after the vehicle returns to its flat running position and said cooperating means are disengaged, thereby to expel a parachute contained in said cavity.

11. A toy vehicle as defined in claim 6 wherein said latching means comprises a lever pivotally mounted in the rear of said vehicle adjacent said cavity, said lever having an abutment surface adapted to engage said piston in the innermost position thereof wherein the biasing force of said spring means normally holds the piston against said abutment surface to hold the lever in a first position; said lever having an arm extending outwardly of the vehicle body and located above the surface along which the vehicle moves when it is in a flat out running position and positioned to engage the surface along which the vehicle moves when the vehicle is in a "wheelie" position to pivot the lever to a second position in which the abutment surface is disengaged from the piston.

12. A toy vehicle as defined in claim 6 wherein said piston rod is flexible and said cooperating means comprises a recess formed in said piston rod and having an abutment surface facing in the direction of the biasing force of said spring means, and a stop surface on said vehicle received in said recess in engagement with said abutment shoulder.

13. A toy vehicle as defined in claim 12 wherein said means for disengaging said cooperating means comprises an extension of said piston rod extending through said vehicle body and formed to engage the surface on which the vehicle moves when the vehicle is in its flat running position to flex said piston rod upwardly and disengage said abutment shoulder from said stop.

14. The toy vehicle as defined in claim 13 wherein said latching means comprises a lever pivotally mounted in the rear of said vehicle adjacent said cavity, said lever having an abutment surface adapted to engage said piston in the innermost position thereof wherein the biasing force of said spring means normally holds the piston against said abutment surface to hold the lever in a first position; said lever having an arm extending outwardly of the vehicle body and located above the surface along which the vehicle moves when it is in a flat out running position and positioned to engage the surface along which the vehicle moves when the vehicle is in a "wheelie" position to pivot the lever to a second position in which the abutment surface is disengaged from the piston.

15. The toy vehicle as defined in claim 14 wherein said toy vehicle body has an upwardly inclined rear end portion containing said cavity, said inclined rear end portion of the vehicle allowing the vehicle to assume a "wheelie" position.

16. The toy vehicle as defined in claim 15 wherein said lever of said latching means is located in said inclined rear end portion of the vehicle and said arm extends generally horizontally outwardly and rearwardly of said rear end portion in the flat running position of the vehicle.

17. The vehicle as defined in claim 6 wherein said vehicle body includes a longitudinally extensible front end portion.

18. The vehicle as defined in claim 6 including drive means in said vehicle body for propelling the vehicle along its path of travel.

19. The vehicle as defined in claim 18 wherein said drive means comprises a flywheel motor.

* * * * *